US009214261B2

(12) United States Patent
Saito et al.

(10) Patent No.: US 9,214,261 B2
(45) Date of Patent: Dec. 15, 2015

(54) CABLE FOR HIGH-VOLTAGE ELECTRONIC DEVICE

(75) Inventors: Mariko Saito, Minato-ku (JP); Masahiro Minowa, Minato-ku (JP); Junichi Nishioka, Minato-ku (JP); Nahoko Tanaka, Minato-ku (JP)

(73) Assignee: SWCC SHOWA CABLE SYSTEMS CO., LTD., Tokyo (JP)

( * ) Notice: Subject to any disclaimer, the term of this patent is extended or adjusted under 35 U.S.C. 154(b) by 0 days.

(21) Appl. No.: 13/126,945

(22) PCT Filed: Feb. 5, 2010

(86) PCT No.: PCT/JP2010/000699

§ 371 (c)(1),
(2), (4) Date: Apr. 29, 2011

(87) PCT Pub. No.: WO2010/090034

PCT Pub. Date: Aug. 12, 2010

(65) Prior Publication Data

US 2011/0209895 A1 Sep. 1, 2011

(30) Foreign Application Priority Data

Feb. 5, 2009 (JP) ..... 2009-024981

(51) Int. Cl.
*H01B 7/00* (2006.01)
*H01B 9/02* (2006.01)
(Continued)

(52) U.S. Cl.
CPC ..... *H01B 9/027* (2013.01); *H01B 3/28* (2013.01); *H01B 3/441* (2013.01)

(58) Field of Classification Search
CPC ..... H01B 9/027; H01B 3/28; H01B 3/441; H01B 1/24; H01B 3/004; C08K 3/04
USPC ..... 174/115, 72 A, 75 R, 102 SC, 120 SC, 174/84 R, 84 S, 102 SP, 107, 117 F; 439/372, 439/379, 383, 389; 428/372, 379, 383, 389, 428/388, 375
See application file for complete search history.

(56) References Cited

U.S. PATENT DOCUMENTS 3,725,330 A * 4/1973 Shirato et al. ..... 524/430
4,020,213 A * 4/1977 Berglowe et al. ..... 428/379
(Continued)

FOREIGN PATENT DOCUMENTS

CN 1290183 A 4/2001
DE 196 41 396 A1 4/1998
(Continued)

OTHER PUBLICATIONS

Characteristics of Modified Cab-O-Sil in Aqueous Media: Published online Jul. 2, 2002.*
(Continued)

*Primary Examiner* — Jenny L Wagner
*Assistant Examiner* — Pete Lee
(74) *Attorney, Agent, or Firm* — Oblon, McClelland, Maier & Neustadt, L.L.P.

(57) ABSTRACT

A cable for a high-voltage electronic device having a small diameter and an excellent voltage resistance characteristic. The cable includes an inner semiconducting layer, a high-voltage insulator, an outer semiconducting layer, a shielding layer, and a sheath on an outer periphery of a cable core portion, wherein the high-voltage insulator is formed of an insulating composition containing 0.5 to 5 parts by mass of an inorganic filler with respect to 100 parts by mass of an olefin-based polymer, and the inorganic filler has an average dispersed-particle diameter of 1 μm or less.

7 Claims, 1 Drawing Sheet

(51) Int. Cl.
*H01B 3/28* (2006.01)
*H01B 3/44* (2006.01)

(56) References Cited

U.S. PATENT DOCUMENTS

| | | | | |
|---|---|---|---|---|
| 4,623,755 | A * | 11/1986 | Henkel et al. | 174/110 SR |
| 4,639,486 | A * | 1/1987 | Liu | 524/409 |
| 4,684,766 | A | 8/1987 | Tanaka et al. | |
| 4,857,673 | A | 8/1989 | Wilkus et al. | |
| 4,917,965 | A * | 4/1990 | Inoue et al. | 428/614 |
| 5,911,023 | A * | 6/1999 | Risch et al. | 385/100 |
| 6,086,792 | A * | 7/2000 | Reid et al. | 252/511 |
| 6,197,848 | B1 * | 3/2001 | Whitehouse et al. | 523/205 |
| 6,383,634 | B1 * | 5/2002 | Kornfeldt et al. | 428/379 |
| 6,469,088 | B1 * | 10/2002 | Lee | 524/451 |
| 6,811,875 | B2 * | 11/2004 | Kikuchi et al. | 428/372 |
| 6,989,486 | B2 * | 1/2006 | Lovoi et al. | 174/28 |
| 2001/0011106 | A1 | 8/2001 | Yaginuma et al. | |
| 2006/0240254 | A1 * | 10/2006 | Kikuchi et al. | 428/375 |
| 2006/0240255 | A1 | 10/2006 | Kikuchi et al. | |
| 2008/0249240 | A1 * | 10/2008 | Bandyopadhyay | 524/847 |

FOREIGN PATENT DOCUMENTS

| | | |
|---|---|---|
| JP | 48 79284 | 9/1973 |
| JP | 51 41885 | 4/1976 |
| JP | 56 69718 | 6/1981 |
| JP | 56 116734 | 9/1981 |
| JP | 60 243154 | 12/1985 |
| JP | 61 79448 | 4/1986 |
| JP | 3 214509 | 9/1991 |
| JP | 6-260042 | 9/1994 |
| JP | 7-176231 | 7/1995 |
| JP | 2000 56100 | 2/2000 |
| JP | 2001 270989 | 10/2001 |
| JP | 2002 245866 | 8/2002 |
| JP | 2006 134813 | 5/2006 |
| JP | 2006-302835 | 11/2006 |
| JP | 2009 70611 | 4/2009 |
| JP | 11-66976 | 3/2014 |
| WO | 2008 108355 | 9/2008 |

OTHER PUBLICATIONS

Chinese Office Action issued Mar. 5, 2013 in Chinese Patent Application No. 2010800003126.4 with English translation, 10 pages.

European Communication, Supplementary European Search Report issued May 21, 2013 in EP Application No. 1073837534-1302/2395516 PCT/JP2010000699, 5 pages.

Japanese Office Action mailed on Apr. 16, 2013 in application No. JP2009-024981 w/English translation.

Japanese Office Action mailed on Aug. 6, 2013 in application No. JP2009-024981 w/English translation.

JIS C 3005, "Test methods for rubber or plastic insulated wires and cables," Japanese Industrial Standard, pp. 1-34 (2000).

JIS K 6253, "Rubber, vulcanized or thermoplastic—Determination of hardness," Japanese Industrial Standard, pp. 1-38 (2006).

NEMA Standards Publication XR 7, "High-Voltage X-Ray Cable Assemblies and Receptacles," National Electrical Manufacturers Association, 6 total pages. (1995).

International Search Report issued May 18, 2010 in PCT/JP10/00699 filed Feb. 5, 2010.

* cited by examiner

CABLE FOR HIGH-VOLTAGE ELECTRONIC DEVICE

TECHNICAL FILED

The present invention relates to a cable used for a high-voltage electronic device such as a medical CT (computerized tomography) apparatus and X-ray machines.

BACKGROUND ART

Cables, which are used for high-voltage electronic devices such as a medical CT apparatus and an X-ray machine and to which a high direct-current voltage is applied, are required to have (i) a small outside diameter and light weight, (ii) good flexibility and resistance against movement and bending, (iii) small electrostatic capacitance and followability to the repeated application of a high voltage, and (iv) heat resistance to resist against heat generation of an X-ray tube portion.

Conventionally, such a known cable for a high-voltage electronic device (e.g., a cable for X-ray machine) is formed by stranding two lines of low-voltage cable cores and one to two lines of bare conductors, forming an inner semiconducting layer on the strand, and sequentially forming thereon a high-voltage insulator, an outer semiconducting layer, a shielding layer and a sheath. For the high-voltage insulator, a composition based on an EP rubber (ethylene-propylene rubber) which is lightweight and flexible and has relatively good electrical characteristics is used (see for example, Reference 1).

In recent years, the EP rubber composition having a low dielectric constant (about 2.3) has been put into practical use, and it is being used as a material for a high-voltage insulator to develop a cable for a high-voltage electronic device having a smaller diameter (e.g., 75 kV class cable having an outside diameter of about 14 mm) and low electrostatic capacitance.

But, such a cable provided with a small diameter has a problem that its voltage resistance characteristic lowers because the high-voltage insulator becomes thin.

PRIOR ART REFERENCE

Patent Reference

Reference 1: JP-A 2002-245866 (KOKAI)

SUMMARY OF THE INVENTION

Problems to be Solved by the Invention

The present invention has been made in view of the above circumstances and provides a cable for a high-voltage electronic device, which has a small diameter and an excellent voltage resistance characteristic.

Means for Solving the Problems

The cable for a high-voltage electronic device according to an embodiment of the invention comprises an inner semiconducting layer, a high-voltage insulator, an outer semiconducting layer, a shielding layer, and a sheath on an outer periphery of a cable core portion, being characterized in that the high-voltage insulator is formed of an insulating composition containing 0.5 to 5 parts by mass of an inorganic filler with respect to 100 parts by mass of an olefin-based polymer, and that the inorganic filler has an average dispersed-particle diameter of 1 μm or less.

Effects of the Invention

According to an embodiment of the invention, a cable for a high-voltage electronic device having a small diameter and an excellent voltage resistance characteristic can be obtained.

EMBODIMENTS FOR CARRYING OUT THE INVENTION

The embodiments of the present invention are described below with reference to the drawings. Although the description is made based on the drawings, they are provided for illustration only and do not limit the present invention in any respect.

Figure 1:
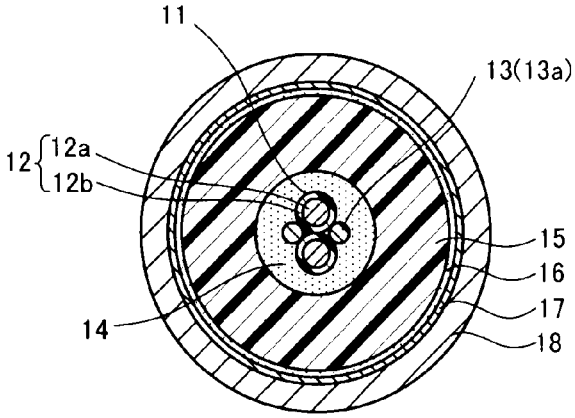
FIG. 1 A transverse sectional view showing an embodiment of the cable for a high-voltage electronic device of the invention.

FIG. 1 is a transverse sectional view showing the cable for a high-voltage electronic device (X-ray machine cable) according to an embodiment of the invention.

In FIG. 1, 11 denotes a cable core portion, and this cable core portion 11 is formed by stranding two lines of low-voltage cable cores 12 and two lines of high-voltage cable cores 13 having a diameter equal to or smaller than the outside diameter of the low-voltage cable core 12. The low-voltage cable core 12 is composed of, for example, a conductor 12*a* having a cross-sectional area of 1.8 $mm^2$ which is formed by concentric stranding of 19 tin-coated annealed copper wires having a diameter of 0.35 mm, and an insulator 12*b* having a thickness of, for example, 0.25 mm which is formed of, for example, a fluorine resin such as polytetrafluoroethylene, and formed on the conductor 12*a*. The high-voltage cable core 13 is composed of a bare conductor 13*a* having a cross-sectional area of 1.25 $mm^2$ which is formed by, for example, concentric stranding of 50 tin-coated annealed copper wires having a diameter of 0.18 mm. Optionally, semiconductive coating may be formed on the bare conductor 13*a*.

An inner semiconducting layer 14, a high-voltage insulator 15 and an outer semiconducting layer 16 are sequentially formed on the outer periphery of the cable core portion 11. The inner semiconducting layer 14 and the outer semiconducting layer 16 are formed by, for example, winding a semiconductive tape formed of a nylon substrate, a polyester substrate or the like and/or extrusion coating of a semiconductive rubber and plastic such as a semiconductive EP rubber.

The high-voltage insulator 15 is formed of an insulating composition containing 0.5 to 5 parts by mass of an inorganic filler with respect to 100 parts by mass of an olefin-based polymer.

Examples of the olefin-based polymer are ethylene-propylene rubbers such as ethylene-propylene copolymer (EPM) and ethylene-propylene-diene copolymer (EPDM), polyethylenes such as low-density polyethylene (LDPE), medium-density polyethylene (MDPE), high-density polyethylene (HDPE), very low-density polyethylene (VLDPE) and linear low-density polyethylene (LLDPE), polypropylene (PP), ethylene-ethyl acrylate copolymer (EEA), ethylene-methyl acrylate copolymer (EMA), ethylene-ethyl methacrylate copolymer, ethylene-vinyl acetate copolymer (EVA), and polyisobutylene. Further, ethylene copolymerized with α-olefine or cyclic olefin such as propylene, butene, pentene, hexane or octane by a metallocene catalyst can also be used. They are used alone or as a mixture. The olefin-based polymer is preferably an ethylene-propylene rubber such as an ethylene-propylene copolymer (EPM), an ethylene-propylene-diene copolymer (EPDM) or the like, and another olefin-based polymer is preferably used as a component used together with the ethylene-propylene rubber. The olefin-based polymer is more preferably an ethylene-propylene rubber, and further more preferably an ethylene-propylene-diene copolymer (EPDM). Specific examples of the ethylene-propylene-diene copolymer (EPDM) are Mitsui EPT (trade name, manufactured by Mitsui Chemicals, Inc.), Esprene EPDM (trade name, manufactured by Sumitomo Chemical Co., Ltd.) and the like.

As the inorganic fillers, there are silica, layered silicate, mica, soft calcium carbonate, magnesium oxide and the like. They are used alone or as a mixture. As the inorganic filler, fumed silica which is produced by a high temperature flame hydrolysis method is preferable. The inorganic filler is blended in 0.5 to 5 parts by mass, and preferably 1 to 2 parts by mass, to 100 parts by mass of the olefin-based polymer. If the blending amount is less than 0.5 part by mass, a sufficient voltage resistance characteristic cannot be obtained, and if it exceeds 5 parts by mass, the composition has a high dielectric constant, and the electrostatic capacitance of the cable increases.

The average dispersed-particle diameter of the inorganic filler is 1 μm or less, preferably 0.9 μm or less, more preferably 0.7 μm or less, and still more preferably 0.5 μm or less. If the average dispersed-particle diameter exceeds 1 μm, a sufficient voltage resistance characteristic cannot be obtained. The lower limit of the average dispersed-particle diameter is not particularly restricted, but it is normally 10 nm or more from the viewpoint of the easiness of making and obtaining.

The average dispersed-particle diameter of the inorganic filler can be confirmed by forming the insulating composition by extrusion molding or the like, trimming/sectioning it by ultramicrotome under freezing condition, dyeing with a metal oxide such as ruthenium tetroxide to form ultra thin pieces, observing, for example, ten pieces under a transmission electron microscope, and figuring out the average.

Specific examples of the inorganic filler used in the invention include, for example, AEROSIL 200 (trade name) having an average primary particle diameter of 12 nm and AEROSIL 300 (trade name) having an average primary particle diameter of 7 nm offered commercially by Nippon Aerosil Co., Ltd.

The high-voltage insulator 15 is formed by mixing an inorganic filler to the olefin-based polymer to prepare an insulating composition, coating the obtained insulating composition on an inner semiconducting layer 14 by extrusion or winding a tape-shaped insulating composition. A method of mixing the olefin-based polymer and the inorganic filler is not particularly restricted as far as the average dispersed-particle diameter of the inorganic filler can be controlled within the above range, and a method of homogeneous kneading using, for example, an ordinary kneader such as a Banbury mixer, a tumbler, a pressurizing kneader, a kneading extruder, a mixing roller or the like can be used.

Crosslinking of a polymer component is preferably conducted after coating or forming the insulating composition in view of improvement of heat resistance and mechanical properties. Available methods of crosslinking include a chemical crosslinking method which previously adds a crosslinking agent to an insulating composition, and performs crosslinks after forming, and an electron beam crosslinking method which performs electron beam irradiation, and the like. The crosslinking agents used to perform the chemical crosslinking method are dicumyl peroxide, di-tert-butyl peroxide, 2,5-dimethyl-2,5-di(tert-butylperoxy)hexane, 2,5-dimethyl-2,5-di(tert-butylperoxy)hexyne-3,1,3-bis(tert-butylperoxyisopropyl)benzene, 1,1-bis(tert-butylperoxy)-3,3,5-trimethylcyclohexane, n-butyl-4,4-bis(tert-butylperoxy)valerate, benzoyl oxide, 2,4-dichlorobenzoyl peroxide, tert-butylperoxybenzoate, tert-butylperoxyisopropyl carbonate, diacetyl peroxide, lauroyl peroxide, and tert-butylcumyl peroxide.

A crosslinking degree is preferably 50% or more at a gel fraction, and more preferably 65% or more. If the gel fraction is less than 50%, the heat resistance and mechanical properties cannot be improved sufficiently. This gel fraction is measured according to the testing method for degree of crosslinking specified in JIS C 3005.

In addition to the above-described components, the insulating composition may be optionally blended with inorganic fillers, processing aids, crosslinking aids, flame retardants, antioxidants, ultraviolet absorbers, coloring agents, softening agents, plasticizers, lubricants, and other additives in a range not inhibiting the effects of the invention.

In addition, the insulating composition, when measured according to JIS K 6253, has a type A durometer hardness of preferably 90 or less, more preferably 80 or less, and still more preferably 65 or less. If the type A durometer hardness exceeds 90, the cable flexibility and easiness of use are degraded.

The insulating composition has a dielectric constant of preferably 2.8 or less, more preferably 2.6 or less, and still more preferably 2.4 or less, when measured by a high-voltage Schering bridge method under conditions of 1 kV and a frequency of 50 Hz. If the dielectric constant exceeds 2.8, it is hard to reduce the cable diameter to a small size.

The inner semiconducting layer 14 is determined to have an outside diameter of, for example, 5.0 mm, and the high-voltage insulator 15 and the outer semiconducting layer 16 are coated to have, for example, a thickness of 3.0 mm and 0.2 mm respectively.

The outer semiconducting layer 16 has thereon, for example, a shielding layer 17 having a thickness of 0.3 mm which is composed of a braid of tin-coated annealed copper wires and has thereon a sheath 18 having, for example, a thickness of 1.0 mm formed by extrusion coating of a soft vinyl chloride resin.

The above-configured cable for a high-voltage electronic device (X-ray machine cable) can be provided with a good voltage resistance characteristic even if its diameter is small (e.g., about 13 to 14 mm of outside diameter for 75 kV class cable) because the high-voltage insulator 15 is formed of an insulating composition containing an inorganic filler having an average dispersed-particle diameter of 1 μm or less at a particular ratio with respect to the olefin-based polymer.

Figure 2:
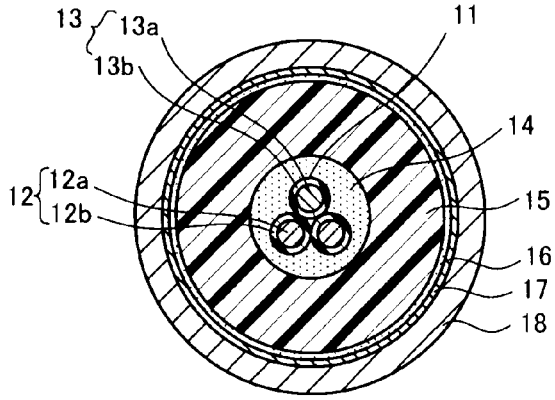
FIG. 2 A transverse sectional view showing another embodiment of the cable for a high-voltage electronic device of the invention.
Figure 3:
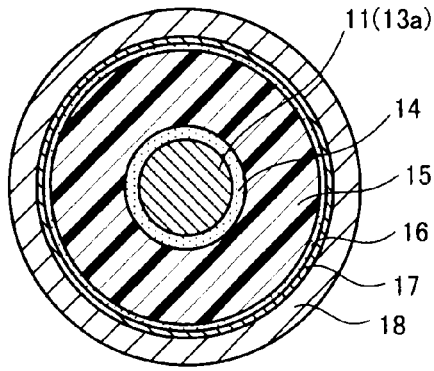
FIG. 3 A transverse sectional view showing still another embodiment of the cable for a high-voltage electronic device of the invention.

FIG. 2 and FIG. 3 each are transverse sectional views showing another embodiments of the cable for a high-voltage electronic device of the invention.

The cable for a high-voltage electronic device shown in FIG. 2 is configured in the same manner as the cable for a high-voltage electronic device shown in FIG. 1 except that the cable core portion 11 is configured by stranding two lines of the low-voltage cable cores 12 and one line of the high-voltage cable core 13 (the drawing shows an example that a semiconductive coating 13*b* is formed on the bare conductor 13*a*). The cable for a high-voltage electronic device shown in FIG. 3 is an example of a so-called single core cable, which has a structure that the cable core portion 11 is formed of the conductor 13*a* only, and the inner semiconducting layer 14, the high-voltage insulator 15, the outer semiconducting layer 16, the shielding layer 17 and the sheath 18 are sequentially formed on the cable core portion (conductor 13*a*). The above cables for a high-voltage electronic device can also be provided with a good voltage resistance characteristic even if they have a small diameter (e.g., about 13 to 14 mm of diameter for 75 kV class cable) similar to the above-described embodiment.

EXAMPLES

Though the present invention is described in further detail with reference to the examples, the invention is not limited to these examples.

Example 1

On a conductor having a cross-sectional area of 1.8 $mm^2$ which was formed by concentric stranding of 19 tin-coated annealed copper wires having a diameter of 0.35 mm, two lines of low-voltage cable cores having an insulator formed of polytetrafluoroethylene and having a thickness of 0.25 mm and two lines of high-voltage cable cores composed of a bare conductor having a cross-sectional area of 1.25 $mm^2$ which was formed by concentric stranding of 50 tin-coated annealed copper wires having a diameter of 0.18 mm were stranded, and then a semiconductive tape formed of a nylon substrate was wound around the outer periphery to form an inner semiconducting layer having a thickness of about 0.5 mm.

An insulating composition, which was prepared by homogeneously kneading 100 parts by mass of EPDM (Mitsui EPT #1045, trade name, manufactured by Mitsui Chemicals, Inc.), 0.5 part by mass of fumed silica (AEROSIL 300, trade name, manufactured by Nippon Aerosil Co., Ltd.) and 2.5 parts by mass of dicumyl peroxide (DCP) by a mixing roll, was extrusion coated on the inner semiconducting layer and heat-crosslinked to form a high-voltage insulator having a thickness of 2.7 mm. A semiconductive tape formed of a nylon substrate was further wound on it to dispose an outer semiconducting layer having a thickness of about 0.15 mm. A shielding layer formed of a braid of tin-coated annealed copper wires and having a thickness of 0.3 mm was formed on the outer semiconducting layer, and a soft vinyl chloride resin sheath was extrusion-coated on its exterior to produce a cable for a high-voltage electronic device (X-ray machine cable) having an outside diameter of 13.2 mm.

Examples 2 to 3 and Comparative Examples 1 to 4

Cables for a high-voltage electronic device were produced in the same manner as in Example 1 except that the compositions of the high-voltage insulator were changed as shown in Table 1.

The obtained cables for a high-voltage electronic device were measured or evaluated for electrostatic capacitance and voltage resistance characteristic by the following methods.

[Electrostatic Capacitance]

Electrostatic capacitance was measured by a high-voltage Schering bridge method under conditions of 1 kV and a frequency of 50 Hz.

[Voltage Resistance Characteristic]

It was judged to be accepted (O) if there was not an insulation breakdown or rejected (×) if there was an insulation breakdown under application conditions of AC voltage of 53 kV and 200 hours according to NEMA (National Electrical Manufactures Association) Standard (XR7).

The results are shown in Table 1 together with an average dispersed-particle diameter of an inorganic filler (fumed silica) in the high-voltage insulator and the physical properties (hardness and dielectric constant) of the high-voltage insulator. Their measuring methods are as follows.

[Average Dispersed-Particle Diameter of Inorganic Filler]

Ultra thin pieces were prepared by cutting specimens (1 mm square) from the high-voltage insulator, embedding a resin(epoxy resin), trimming/sectioning under a freezing condition by ultramicrotome EM-ULTRACUT-UCT manufactured by Leica Camera AG, and steam dyeing using ruthenium tetroxide. The ultra thin pieces were observed under a transmission electron microscope H-7100FA (acceleration voltage of 100 kV) manufactured by Hitachi, Ltd. to determine ten dispersed-particle diameters, and their average value was calculated.

[Hardness of High-Voltage Insulator]

A sheet specimen having a thickness of 2 mm was prepared independent of the production of the cable and measured by the type A durometer of JIS K 6253.

[Dielectric Constant of High-Voltage Insulator]

A sheet specimen having a thickness of 0.5 mm was prepared independently from the production of the cable, and measured by the high-voltage Schering bridge method under conditions of 1 kV and a frequency of 50 Hz.

TABLE 1

| | | Example 1 | Example 2 | Example 3 | Comparative Example 1 | Comparative Example 2 | Comparative Example 3 | Comparative Example 4 |
|---|---|---|---|---|---|---|---|---|
| Composition (*) | EPDM | 100 | 100 | 100 | 100 | 100 | 100 | 100 |
| | Fumed silica | 0.5 | 1.0 | 5.0 | — | 0.3 | 10.0 | 20.0 |
| | Crosslinking agent | 2.5 | 2.5 | 2.5 | 2.5 | 2.5 | 2.5 | 2.5 |
| Physical properties Characteristic evaluation | Average dispersed-particle diameter of inorganic filler (μm) | 0.5 | 0.7 | 0.9 | — | 0.5 | 1.1 | 2.0 |
| | High-voltage insulator durometer hardness (type A) | 52 | 54 | 60 | 50 | 51 | 70 | 80 |

TABLE 1-continued

| | Example 1 | Example 2 | Example 3 | Comparative Example 1 | Comparative Example 2 | Comparative Example 3 | Comparative Example 4 |
|---|---|---|---|---|---|---|---|
| Dielectric constant of high-voltage insulator | 2.2 | 2.3 | 2.3 | 2.2 | 2.2 | 2.5 | 3.1 |
| Electrostatic capacitance (μF/km) | 0.181 | 0.183 | 0.186 | 0.178 | 0.180 | 0.210 | 0.250 |
| Voltage resistance characteristic | ○ | ○ | ○ | x | x | x | x |

(*) Unit: parts by mass

It is apparent from Table 1 that though the cables in the example had a small outside diameter of 13.2 mm, they had the voltage resistance characteristic and electrostatic capacitance satisfying the required performance of the NEMA Standard (XR7) (electrostatic capacitance of the NEMA Standard (XR7) is 0.187 μF/km or less). Meanwhile, in Comparative Examples 1 and 2 wherein the inorganic filler was not blended or blended in an excessively small amount, the electrostatic capacitance of the cable satisfied the required performance of the NEMA Standard, but the voltage resistance characteristic was insufficient. In Comparative Examples 3 and 4 wherein the inorganic filler was blended in an excessive amount and the average dispersed-particle diameter was excessively large, both the electrostatic capacitance and the voltage resistance characteristic could not satisfy the required performance of the NEMA Standard.

As described above, the present invention has the high-voltage insulator formed of the insulating composition containing the inorganic filler having an average dispersed-particle diameter of 1 μm or less at a specified ratio in the olefin-based polymer. Thus, a cable for a high-voltage electronic device which has a small diameter, a small electrostatic capacitance and sufficient insulation performance can be obtained.

As described above, according to the present invention, it becomes possible to obtain a cable for a high-voltage electronic device which has a small diameter, a small electrostatic capacitance and sufficient insulation performance by employing the high-voltage insulator formed of the insulating composition containing the inorganic filler having an average dispersed-particle diameter of 1 μm or less at a specified ratio in the olefin-based polymer.

DESCRIPTION OF THE REFERENCIAL NUMERALS

11 . . . . Cable core portion, 12 . . . low-voltage cable core, 13 . . . high-voltage cable core, 14 . . . inner semiconducting layer, 15 . . . high-voltage insulator, 16 . . . outer semiconducting layer, 17 . . . shielding layer, 18 . . . sheath

What is claimed is:

1. An X-ray machine cable, comprising:

a cable core portion; and an inner semiconducting layer;

a high-voltage insulator;

an outer semiconducting layer;

a shielding layer; and a sheath sequentially formed on an outer periphery of a cable core portion, wherein the high-voltage insulator is formed of an insulating composition containing 0.5 to 5 parts by mass of an inorganic filler and 100 parts by mass of ethylene-propylene-diene copolymer, the inorganic filler consisting of fumed silica, the fumed silica dispersed as particles having an average dispersed-particle diameter of 0.5 to 0.9 μm in the insulator, and wherein the cable has an outside diameter of about 13 to about 14 mm.

2. The cable according to claim 1, wherein the ethylene-propylene-diene copolymer is chemically crosslinked with a crosslinking agent.

3. The cable according to claim 2, wherein the crosslinking degree is 50% or more at a gel fraction as measured according to JIS C 3005.

4. The cable according to claim 2, wherein the crosslinking agent is dicumyl peroxide.

5. The cable according to claim 1, wherein the composition consists of the fumed silica, the ethylene-propylene-diene copolymer, and a crosslinking agent.

6. The cable according to claim 5, wherein the crosslinking agent is dicumyl peroxide.

7. The cable according to claim 1, wherein the high-voltage insulator is formed of an insulating composition containing 0.5 to 2 parts by mass of the inorganic filler.

* * * * *